US009831581B2

(12) United States Patent
Fu et al.

(10) Patent No.: US 9,831,581 B2
(45) Date of Patent: Nov. 28, 2017

(54) CONNECTOR AND CONNECTOR ASSEMBLY ALLOWING REPEATED INSERTION AND REMOVAL OF A WIRE

(71) Applicant: Tyco Electronics (Shanghai) Co. Ltd., Shanghai (CN)

(72) Inventors: Xiaozhi Fu, Shanghai (CN); Hongjun Yin, Shanghai (CN); Xiang Xu, Shanghai (CN); Ming Shi, Shanghai (CN)

(73) Assignee: Tyco Electronics (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 15/264,716

(22) Filed: Sep. 14, 2016

(65) Prior Publication Data

US 2017/0077622 A1 Mar. 16, 2017

(30) Foreign Application Priority Data

Sep. 14, 2015 (CN) ..... 2015 2 0709831 U

(51) Int. Cl.

| | |
|---|---|
| ***H01R 4/24*** | (2006.01) |
| ***H01R 4/26*** | (2006.01) |
| ***H01R 11/20*** | (2006.01) |
| ***H01R 12/75*** | (2011.01) |
| ***H01R 4/48*** | (2006.01) |

(52) U.S. Cl.

CPC ..... *H01R 12/75* (2013.01); *H01R 4/4827* (2013.01)

(58) Field of Classification Search

CPC .. H01R 9/2408; H01R 9/2416; H01R 13/635; H01R 12/515; H01R 4/48; H01R 4/4818

USPC ..... 439/717, 725, 438, 853, 437, 441, 835

See application file for complete search history.

(56) References Cited

U.S. PATENT DOCUMENTS

| | | | | | |
|---|---|---|---|---|---|
| 4,299,436 | A * | 11/1981 | Ackerman | H01R 13/11 | 439/84 |
| 6,004,168 | A * | 12/1999 | Fuchs | H01R 4/4845 | 439/630 |
| 6,126,494 | A * | 10/2000 | Fuchs | H01R 4/4845 | 439/441 |
| 7,513,793 | B2 * | 4/2009 | Horst | H01R 4/4818 | 439/427 |
| 8,328,586 | B2 * | 12/2012 | Bies | H01R 4/4836 | 439/725 |
| 8,968,022 | B2 * | 3/2015 | Mostoller | H01R 4/4836 | 439/438 |
| 9,276,334 | B1 * | 3/2016 | Daily | H01R 4/4827 | |
| 9,444,155 | B2 * | 9/2016 | Chen | H01R 4/48 | |

* cited by examiner

*Primary Examiner* — Hae Moon Hyeon

(74) *Attorney, Agent, or Firm* — Barley Snyder

(57) ABSTRACT

A connector is disclosed. The connector has a housing and a conductive terminal disposed in the housing. The conductive terminal has a pair of resilient contact arms including a pair of clamping portions clamping a wire therebetween and a pair of releasing portions adapted to move the pair of resilient contact arms away from each other, each of the pair of resilient contact arms includes one clamping portion and one releasing portion disposed at a free end.

18 Claims, 6 Drawing Sheets

CONNECTOR AND CONNECTOR ASSEMBLY ALLOWING REPEATED INSERTION AND REMOVAL OF A WIRE

CROSS-REFERENCE TO RELATED APPLICATIONS

This application claims the benefit of the filing date under 35 U.S.C. §119(a)-(d) of Chinese Patent Application No. 201520709831.6, filed on Sep. 14, 2015.

FIELD OF THE INVENTION

The present invention relates to a connector and a connector assembly, and more particularly, to a connector and a connector assembly connected to a wire.

BACKGROUND

In many known electrical connectors, once a wire is inserted into the connector it cannot be removed intact and cannot be replaced. Furthermore, the housings of known connectors are molded to accommodate a particular number of conductive terminals of specific sizes and shapes. Providing a plurality of different molds to manufacture connector housings receiving different numbers of conductive terminals is costly and inefficient.

SUMMARY

An object of the invention, among others, is to provide a connector allowing repeated insertion and removal of a wire, which can be assembled with other identical connectors to accommodate different numbers of conductive terminals. The disclosed connector has a housing and a conductive terminal disposed in the housing. The conductive terminal has a pair of resilient contact arms including a pair of clamping portions clamping a wire therebetween and a pair of releasing portions adapted to move the pair of resilient contact arms away from each other, each of the pair of resilient contact arms includes one clamping portion and one releasing portion disposed at a free end.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of a connector. This invention may, however, be embodied in many different forms and should not be construed as limited to the embodiments set forth herein; rather, these embodiments are provided so that this disclosure will be thorough and complete and still fully convey the scope of the invention to those skilled in the art.

Figure 1A:
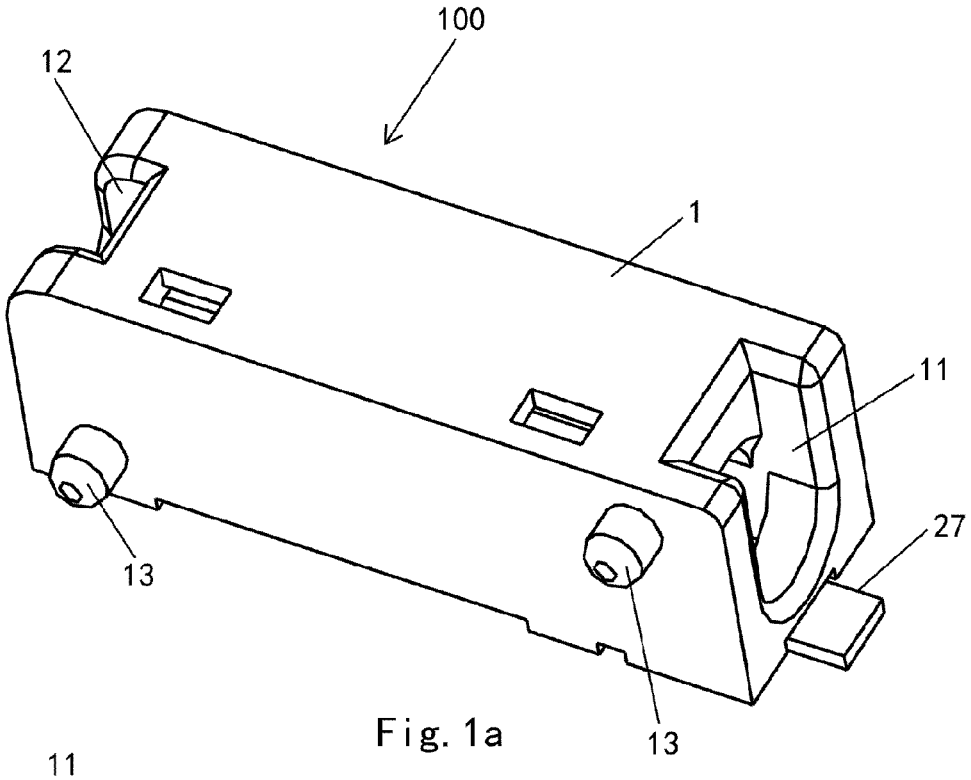
FIG. 1*a* is a perspective view of a connector according to the invention.
Figure 1B:
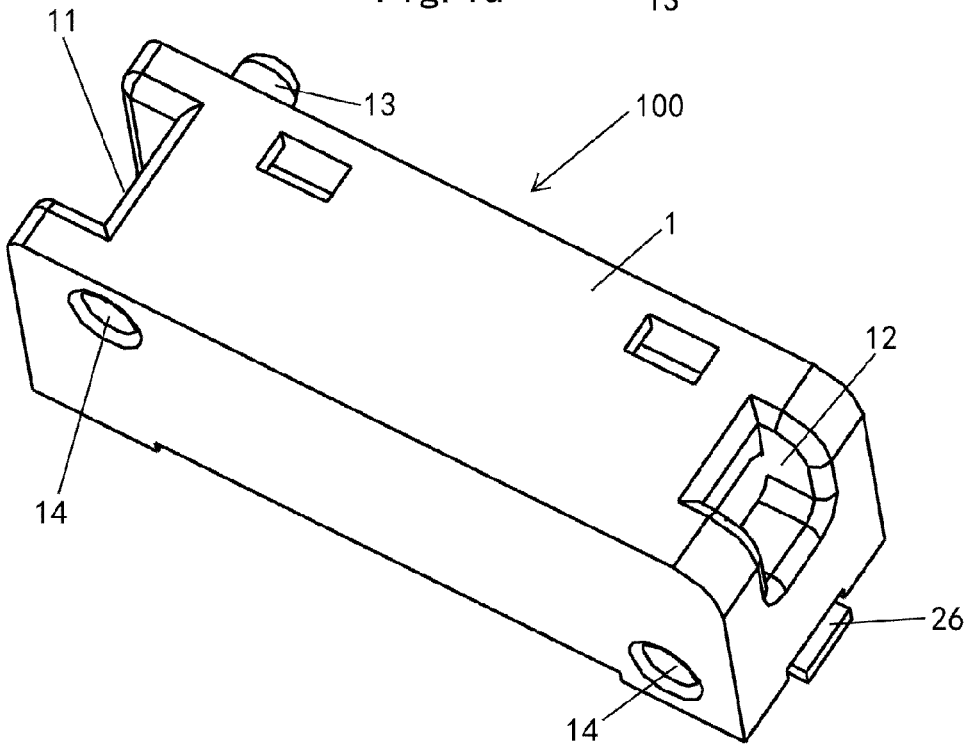
FIG. 1*b* is a perspective view of the connector of FIG. 1*a;*
Figure 2A:
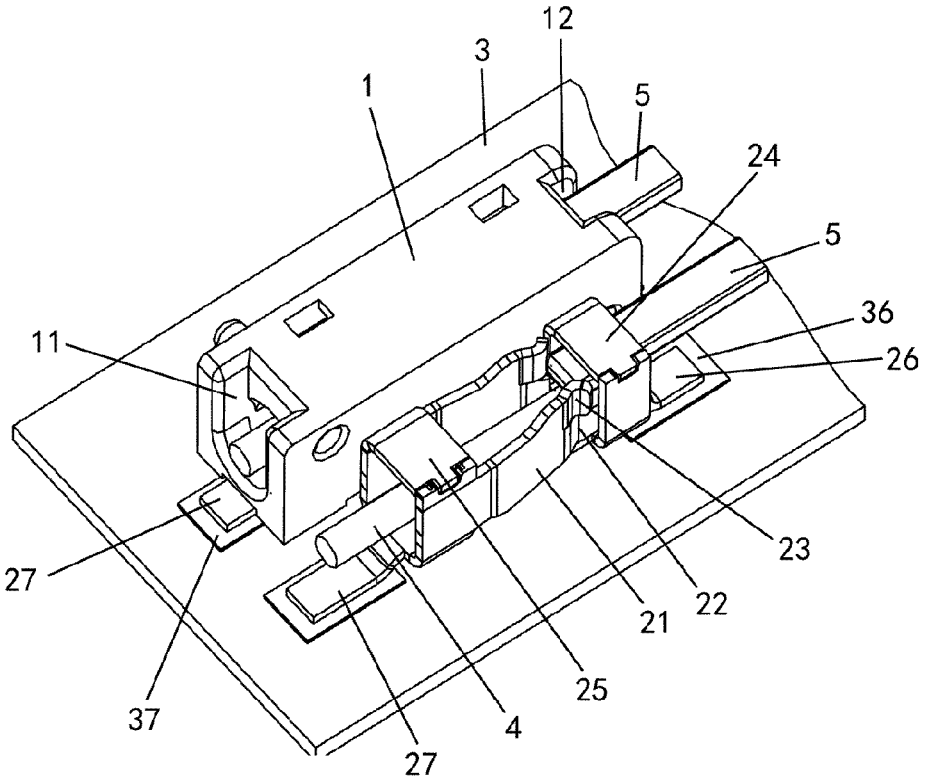
FIG. 2*a* is a perspective view of a plurality of connectors of FIG. 1*a* disposed on a circuit board, wherein a housing of the connector is removed.
Figure 2B:
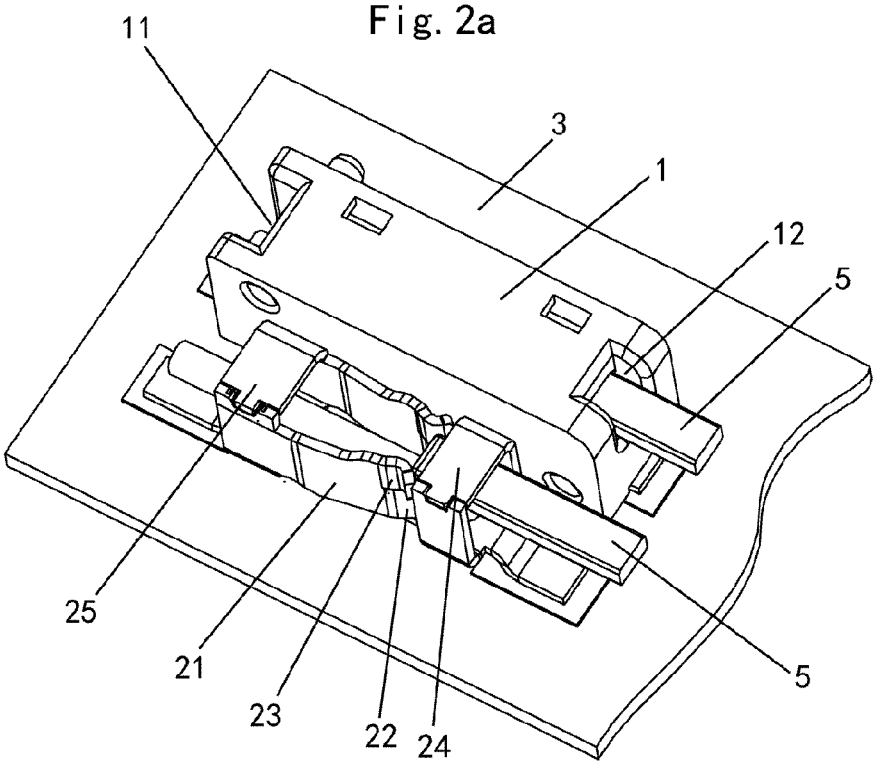
FIG. 2*b* is a perspective view of a plurality of connectors of FIG. 1*a* disposed on the circuit board, wherein the housing of the connector is removed.
Figure 3A:
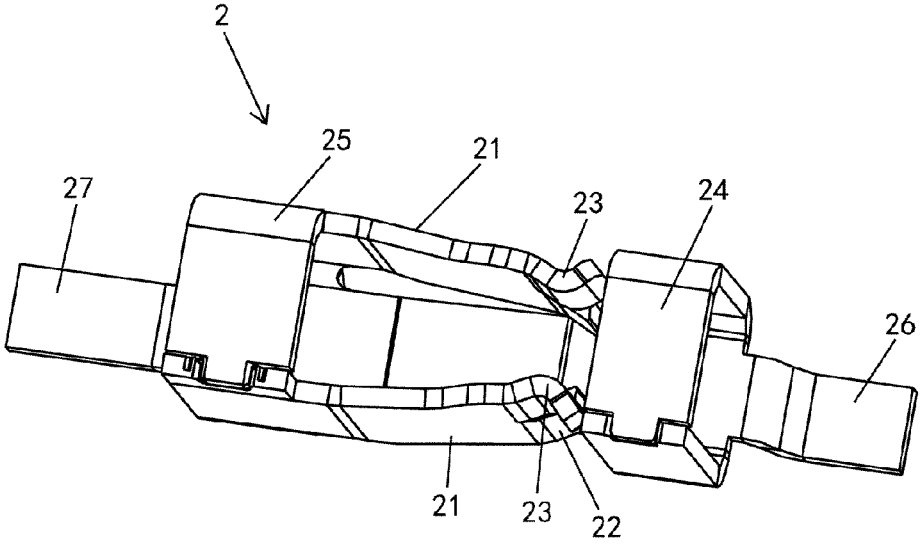
FIG. 3*a* is a perspective view of a conductive terminal of the connector of FIG. 1*a;*
Figure 3B:
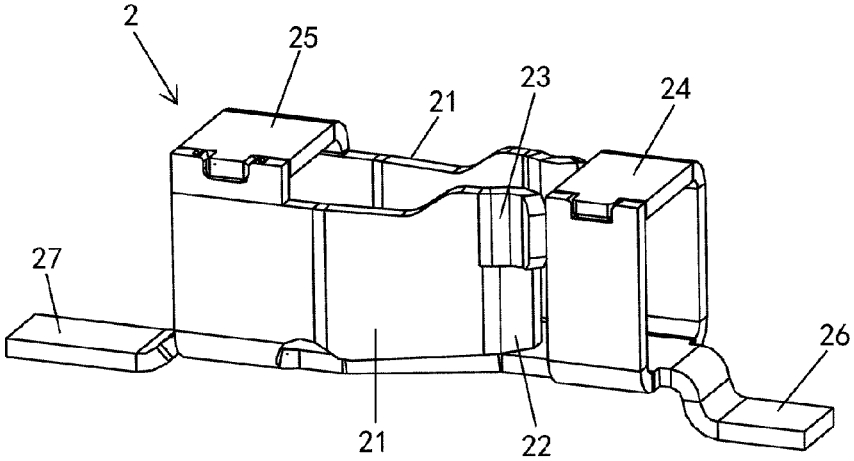
FIG. 3*b* is a perspective view of the conductive terminal of FIG. 3*a;*

A connector 100 according to the invention is shown generally in FIGS. 1*a* and 1*b*. The connector 100 has a housing 1 and a conductive terminal 2.

The major components of the invention will now be described in greater detail.

The housing 1 is shown in FIGS. 1*a*, 1*b*, 2*a*, 2*b*, 6*a*, and 6*b*. In the shown embodiment, the housing 1 is made of an insulative material, such as a plastic, and is formed by molding. As shown in FIGS. 1*a* and 1*b*, the housing 1 has a first side wall and an opposite second side wall, and a first end and an opposite second end. The first side wall is provided with a plurality of projections 13, and the second side wall is provided with a plurality of connecting holes 14 respectively corresponding to the plurality of projections 13. The housing 1 also has a wire receiving passageway 11 disposed at the first end and a releasing passageway 12 disposed at the second end.

Figure 4:
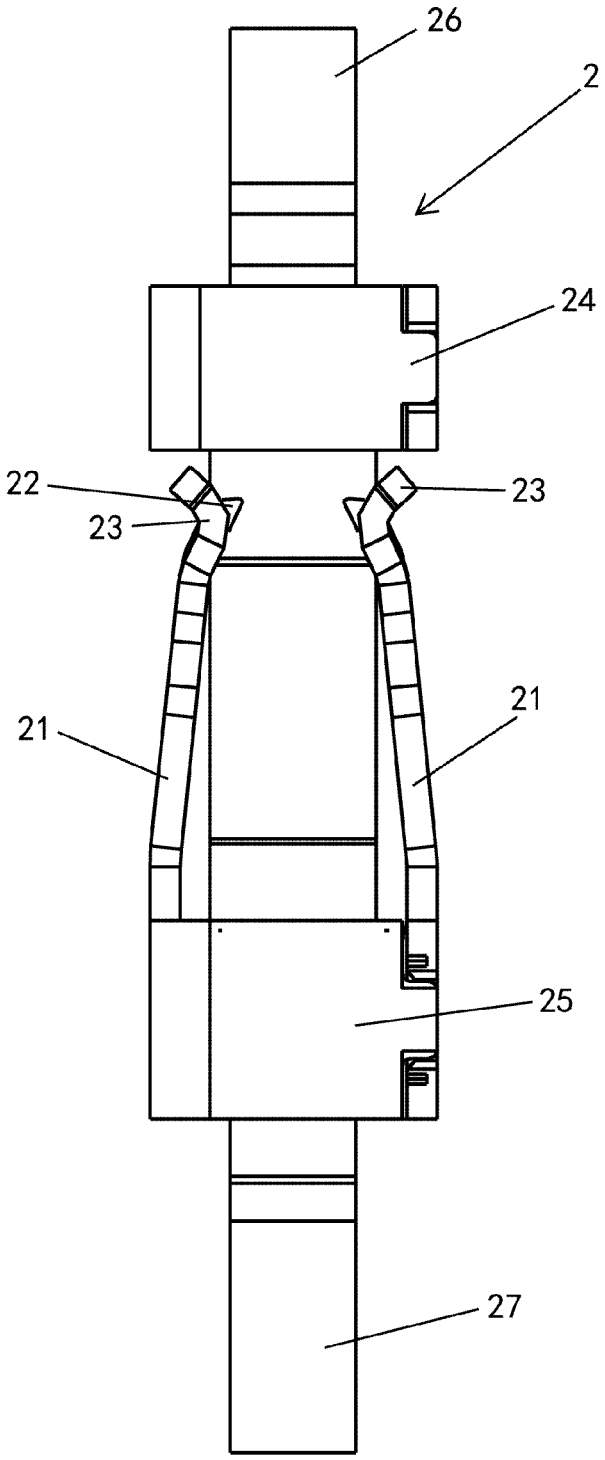
FIG. 4 is a plan view of the conductive terminal of FIG. 3*a;*

The conductive terminal 2 is shown in FIGS. 2*a*-5*b*. As shown in FIGS. 3*a*, 3*b*, and 4, the conductive terminal 2 has a first annular end portion 25 located at a first end and a second annular end portion 24 located at an opposite second end. The conductive terminal 2 also has a pair of resilient contact arms 21, a first solder foot 27 and a second solder foot 26. The conductive terminal 2 may be formed from a metal material by a rolling process.

The pair of resilient contact arms 21 is cantilevered and has a fixed end and a free end. The fixed end of each of the resilient contact arms 21 is attached to the first annular end portion 25. Each resilient contact arm 21 is attached to a side of the first annular end portion 25 at the first end of the conductive terminal 2 and extends toward the second annular end portion 24 at the opposite second end of the conductive terminal 2.

The pair of resilient contact arms 21 has a pair of clamping portions 22 and a pair of releasing portions 23. Each of the resilient contact arms 21 has a clamping portion 22 and a releasing portion 23 disposed at the free end. The releasing portion 23 is formed as an arc-shaped portion at an upper side of the free end of the resilient contact arm 21, the releasing portion 23 curving toward an exterior of the conductive terminal 2. The clamping portion 22 is formed as a curved portion at an opposite lower side of the free end of the resilient contact arm 21, the clamping portion 22 curving toward an interior of the conductive terminal 2. The clamping portion 22 and the releasing portion 23 of one of the pair of resilient contact arms 21 respectively face the clamping portion 22 and the releasing portion 23 of the other of the pair of resilient contact arms 21.

The first solder foot 27 extends from a bottom of the first annular end portion 25 in a direction away from the conductive terminal 2, and the second solder foot 26 extends from a bottom of the second annular end portion 24 in a direction away from the conductive terminal 2.

The housing 1 receives the conductive terminal 2 such that the conductive terminal 2 is disposed in an interior of the housing 1, as shown in FIGS. 1, 2, and 6. The first solder foot 27 and the second solder foot 26 extend outside a bottom wall of the housing 1, as shown in FIGS. 1*a* and 1*b*.

Figure 5A:
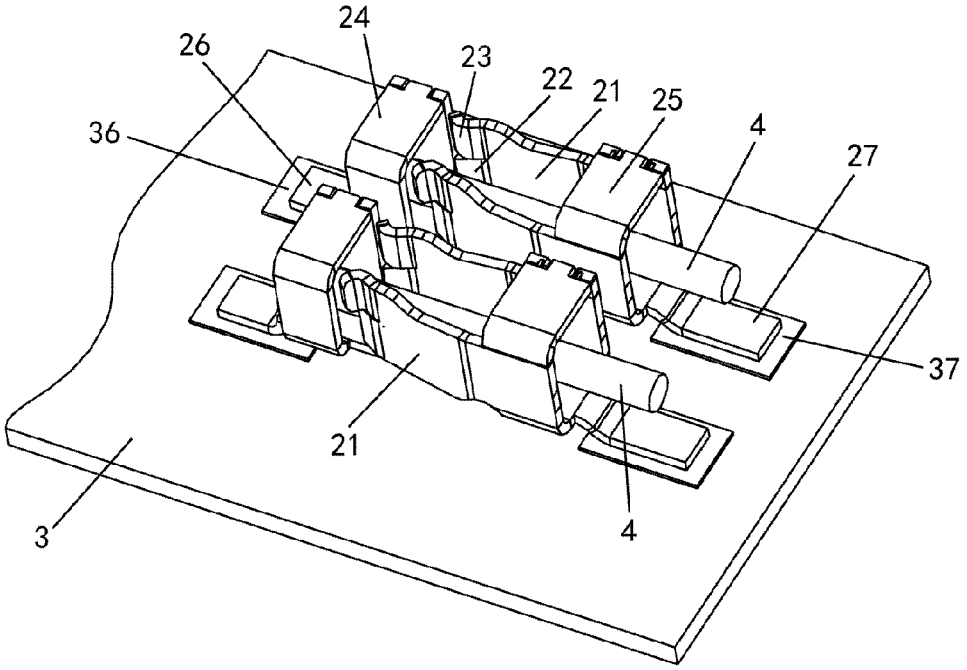
FIG. 5*a* is a perspective view of the conductive terminal of FIG. 3*a* disposed on the circuit board.
Figure 5B:
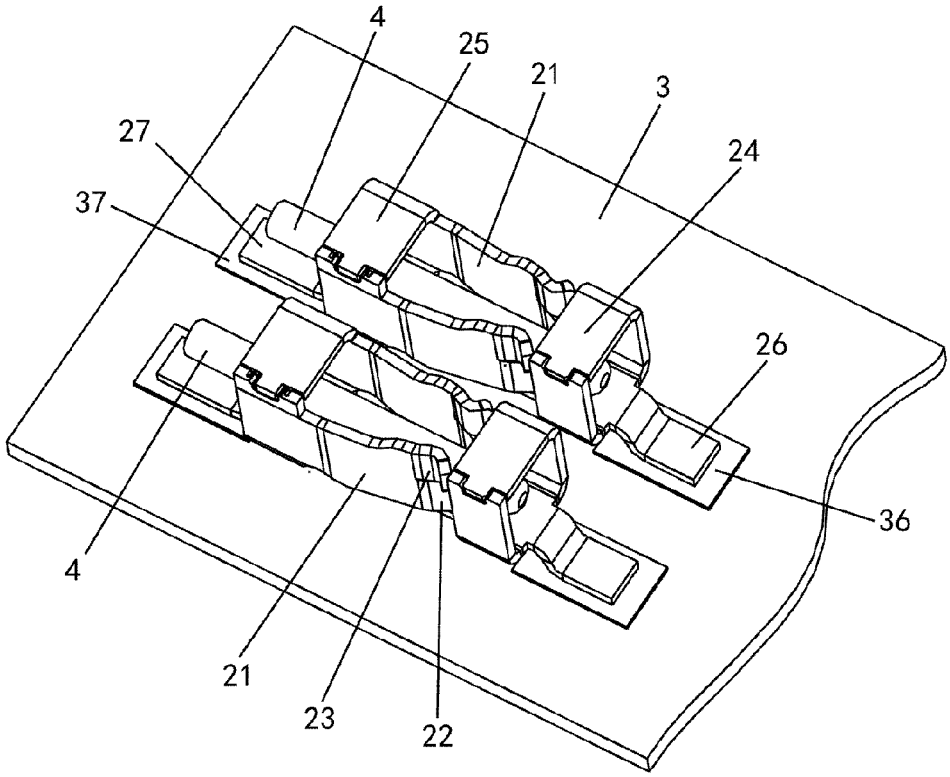
FIG. 5*b* is a perspective view of the conductive terminal of FIG. 3*a* disposed on the circuit board.

The attachment of the connector 100 to a wire 4 will now be described in greater detail with reference to FIGS. 2, 5, and 6. The wire 4 is inserted through the wire receiving portion 11 and between the pair of resilient contact arms 21 through the first annular end portion 25. An end of the wire 4 is disposed in the second annular end portion 24. The pair of clamping portions 22 clamp and puncture into the wire 4 to hold the wire 4 therebetween and form a reliable electrical connection with the wire 4.

The attachment of the connector 100 to a circuit board 3 will now be described in greater detail with reference to FIGS. 2, 5, and 6. The first solder foot 27 and the second solder foot 26 are each soldered to pads 36 and 37, respectively, on the circuit board 3 by means of surface-mount technology (SMT), in which electronic components are mounted directly onto the surface of a circuit board.

An external releasing tool 5, as shown in FIG. 2, is adapted to be inserted into the releasing passageway 12. As shown in FIGS. 1*a* and 1*b*, the position of the releasing passageway 12 is higher than that of the wire receiving passageway 11, so that the external releasing tool 5 may press against the releasing portions 23 located at the upper side of the resilient contact arms 21. In the shown embodiment, the external releasing tool 5 is a plate-shaped member, but may alternatively be any other structure capable of contacting the releasing portions 23, such as a cylindrical member.

The external releasing tool 5 contacts the pair of releasing portions 23 so as to move the pair of releasing portions 23 in opposite directions away from each other, separating the pair of releasing portions 23. When the pair of releasing portions 23 is separated, the wire 4 is released by the clamping portions 22 and may be smoothly pulled out from the connector 100. Thereafter, a new wire 4 may be inserted between the pair of resilient contact arms 21 and introduced between the clamping portions 22. Subsequently, the external releasing tool 5 is removed, and due to an elastic force the resilient contact arms 21 return to an initial position where the resilient contact arms 21 are close to each other, therefore enabling the clamping portions 22 to clamp the wire 4; in addition, when the wire 4 is pulled back slightly, the clamping portions 22 puncture into the wire 4 so as to form a reliable electrical connection between the conductive terminal 2 and the wire 4 and at the same time clamp the wire 4 firmly.

Figure 6A:
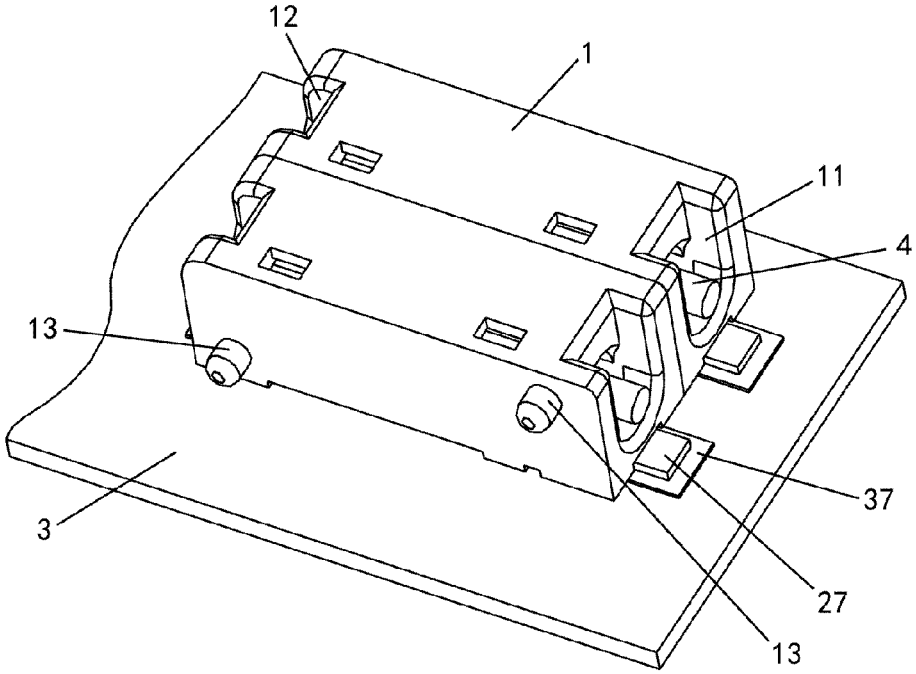
FIG. 6*a* is a perspective view of a plurality of connectors of FIG. 1*a* assembled together and disposed on the circuit board.
Figure 6B:
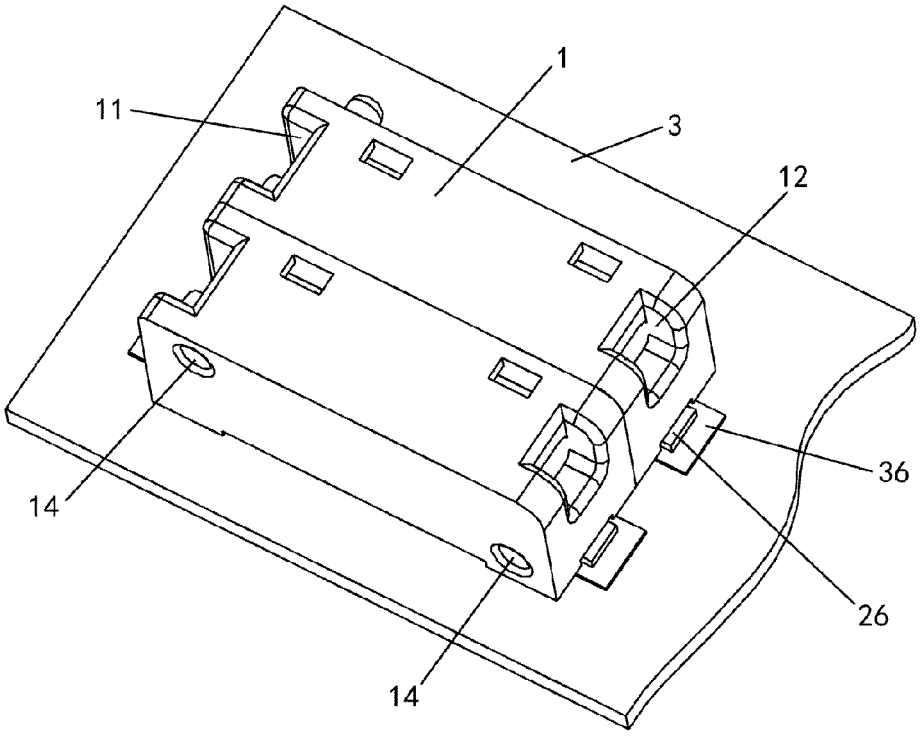
FIG. 6*b* is a perspective view of a plurality of connectors of FIG. 1*a* assembled together and disposed on the circuit board.

As shown in FIGS. 6*a* and 6*b*, a plurality of connectors 100 may be assembled together side by side, wherein the projections 13 of a first of two adjacent connectors 100 are inserted into the connecting holes 14 of a second of two adjacent connectors 100, respectively, thus assembling the two adjacent connectors 100 together. A plurality of connectors 100 may be assembled together side by side and soldered to the circuit board 3.

Advantageously, in the connector 100 according to the invention, since the conductive terminal 2 has the releasing portions 23, the wire 4 may be plugged in and pulled out of the connector 100 repeatedly, permitting convenient replacement of the wire 4. Furthermore, since the releasing portions 23 are located at the free ends of the resilient contact arms 21, each releasing portion 23 has simple structure and is easy to manufacture. Additionally, since identical connectors 100 may be connected to each other, only one mold is required to form a connector assembly with different numbers of conductive terminals 2, reducing manufacturing costs.

What is claimed is:

1. A connector, comprising:

a housing; and a conductive terminal disposed in the housing and having a first annular end portion at a first end of the conductive terminal through which a wire is inserted, a pair of resilient contact arms including a pair of clamping portions clamping the wire therebetween and a pair of releasing portions adapted to move the pair of resilient contact arms away from each other, each of the pair of resilient contact arms including one clamping portion and one releasing portion disposed at a free end, and a second annular end portion at a second end of the conductive terminal opposite the first end, an external releasing tool insertable through the second annular end portion and adapted to move the pair of resilient contact arms away from each other.

2. The connector of claim 1, wherein the housing is formed of an insulative material.

3. The connector of claim 2, wherein the clamping portion and the releasing portion of one of the pair of resilient contact arms respectively face the clamping portion and the releasing portion of the other of the pair of resilient contact arms.

4. The connector of claim 3, wherein the releasing portion is formed as an arc-shaped portion at an upper side of the free end of each resilient contact arm.

5. The connector of claim 4, wherein the releasing portion curves toward an exterior of the conductive terminal.

6. The connector of claim 5, wherein the external releasing tool contacts the pair of releasing portions to move the pair of resilient contact arms away from each other.

7. The connector of claim 6, wherein the external releasing tool is a plate-shaped member.

8. The connector of claim 6, wherein the housing has a releasing passageway at a second end, the external releasing tool inserted through the releasing passageway.

9. The connector of claim 8, wherein the housing has a wire receiving passageway at an opposite first end, the wire inserted through the wire receiving passageway.

10. The connector of claim 6, wherein the clamping portion is formed as a curved portion at an opposite lower side of the free end of each resilient contact arm.

11. The connector of claim 10, wherein the clamping portion curves toward an interior of the conductive terminal.

12. The connector of claim 11, wherein the clamping portion punctures the wire to form an electrical connection with the wire.

13. The connector of claim 3, wherein each of the pair of resilient contact arms is attached to a side of the first annular end portion and extends toward aft the second end of the conductive terminal.

14. The connector of claim 13, wherein an end of the wire is disposed in the second annular end portion.

15. The connector of claim 14, wherein the conductive terminal has a first solder foot extending from a bottom of the first annular end portion in a direction away from the conductive terminal and a second solder foot extending from a bottom of the second annular end portion in a direction away from the conductive terminal.

16. The connector of claim 15, wherein the first solder foot and the second solder foot are soldered to pads of a circuit board.

17. The connector of claim 3, wherein the housing has a first side wall having a plurality of projections and an opposite second side wall having a plurality of connecting holes corresponding to the plurality of projections.

18. A connector assembly, comprising:

a plurality of connectors each having a housing including a first side wall having at least one projection and an opposite second side wall having at least one complementary connecting hole corresponding to the projection, the projection of a first one of the connectors being insertable into the connecting hole of a second one of the connectors to attach the connectors side by side, and a conductive terminal disposed in the housing and having a first annular end portion at a first end of the conductive terminal through which a wire is inserted, a pair of resilient contact arms including a pair of clamping portions clamping the wire therebetween and a pair of releasing portions adapted to move the pair of resilient contact arms away from each other, each of the pair of resilient contact arms including one clamping portion and one releasing portion disposed at a free end, and a second annular end portion at a second end of the conductive terminal opposite the first end, an external releasing tool insertable through the second annular end portion and adapted to move the pair of resilient contact arms away from each other.

* * * * *